US006361363B1

(12) United States Patent
Hwang

(10) Patent No.: US 6,361,363 B1
(45) Date of Patent: Mar. 26, 2002

(54) CABLE CONNECTOR ASSEMBLY DEVICE WITH IMPROVED LATCHING MEANS

(75) Inventor: Jeng-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/693,420

(22) Filed: Oct. 20, 2000

Related U.S. Application Data

(63) Continuation-in-part of application No. 09/574,716, filed on May 18, 2000.

(51) Int. Cl.[7] ..... H01R 13/74
(52) U.S. Cl. ..... 439/555; 439/352
(58) Field of Search ..... 439/350–358, 439/555, 557, 610, 939

(56) References Cited

U.S. PATENT DOCUMENTS 5,518,416 A * 5/1996 Kantner et al. ..... 439/352
6,123,575 A * 9/2000 Huang et al. ..... 439/352

* cited by examiner

*Primary Examiner*—Gary F. Paumen
(74) *Attorney, Agent, or Firm*—Wei Te Chung

(57) ABSTRACT

A cable connector assembly device (100) includes a cable connector assembly (1) and a shroud (80) slidably covering the cable connector assembly. The cable connector assembly includes a pair of USB connectors (10), a pair of conductive latches (40) positioned at either side of the USB connectors and a cover (30) enclosing the USB connectors and mounting the latches therein. When the cable connector assembly is mated to a pair of complementary connectors mounted on an electronic apparatus (2), each latch electrically connects a shell (12) of the USB connectors to a grounded panel (23) of the electronic apparatus. The shroud forms two circular lips (823) at each of opposite sides of a front portion thereof. After the cable connector assembly is mated with the complementary connectors of the electronic apparatus and free ends of the latches engage with the grounded panel, the shroud is pushed forward on the cover so that the circular lips of the shroud abut against a portion of the latches, thereby preventing the latches from disengaging from the grounded panel even under conditions of vibration. Therefore, the cable connector assembly device is securely and reliably mated with the connectors and grounded panel of the electronic apparatus.

1 Claim, 15 Drawing Sheets

CABLE CONNECTOR ASSEMBLY DEVICE WITH IMPROVED LATCHING MEANS

CROSS-REFERENCED APPLICATION

This application is a continuation-in-part (CIP) application of U.S. patent application Ser. No. 09/574,716, filed on May 18, 2000 assigned to the same assignee.

BACKGROUND OF THE INVENTION

1. Field of the Invention

The present invention relates to a connector, and particularly to a cable connector assembly device having latches for securely attaching the assembly to a panel of an electronic apparatus and having a shroud for preventing the latches from disengaging from the panel under conditions of vibration when the shroud is actuated.

2. Description of the Prior Art

Generally, cable connectors are used to connect an electronic apparatus, such as a personal computer, to a peripheral device, such as a printer. The cable connectors are typically connected to the electronic apparatus by latching means positioned on both sides thereof. The latching means is made from resilient metal sheet. To make manipulation more convenient, the Young's modulus of the metal sheet is relatively low. When the cable connector is mated to the electronic apparatus, the latches are pressed inwardly such that distal ends of the latches are fixedly received in openings of a grounded panel of the electronic apparatus. The latches engage with the grounded panel because of their resiliency. Nevertheless, since they have a low Young's modulus, the latches can easily disengage from the panel under conditions of vibration. As a result, the electronic apparatus may not pass a vibration test. Therefore, the cable connector cannot be certified to securely and reliably mate with the electronic apparatus. Therefore, an improved cable connector assembly, which solves the above-mentioned problems of the prior art, is desired.

BRIEF SUMMARY OF THE INVENTION

A main object of the present invention is to provide a cable connector assembly device having latches and a shroud capable of preventing the latches from disengaging from a grounded panel of a mating electronic apparatus when the shroud is engaged in a closed position, thereby assuring reliable engagement of the cable connector assembly device to the electronic apparatus even under conditions of vibration.

To fulfill the above objects, a cable connector assembly device includes a cable connector assembly and a shroud partially covering the cable connector assembly. The shroud is slidable in a rear-to-front direction over the cable connector assembly. The cable connector assembly includes a pair of USB connectors, a cable end connecting to the pair of USB connectors, a pair of conductive latches positioned at either side of the USB connectors, a cover enclosing the USB connectors and the cable end at front and rear portions thereof, and grounding bars positioned on outer surfaces of the cover. Each latch is V-shaped and has a first arm electrically engaging with a shrouded shell of the corresponding USB connector, and a second arm extending out from the cover to electrically and mechanically engage with a grounded panel of an electronic apparatus with which the cable connector assembly mates. Each grounding bar has a base portion located on the cover and a pair of conductive tabs extending from the base portion into the cover and electrically engaging with the shrouded shells of the pair of USB connectors. The base portion of each grounding bar forms a pair of spring fingers extending forwardly therefrom. When the cable connector assembly device is mated with the electronic apparatus, the pair of latches engages with the grounded panel of the electronic apparatus and the shroud is moved in the rear-to-front direction over the cable connector assembly, allowing circular lips of the shroud to abut against a portion of each latch to prevent the latches from disengaging from the grounded panel. Further, front free ends of the spring fingers of the grounding bars press against the grounded panel, thereby establishing further electrical connection between the shrouded shells of the USB connectors and the grounded panel of the electronic apparatus.

Other objects, advantages and novel features of the invention will become more apparent from the following detailed description of the present embodiment when taken in conjunction with the accompanying drawings.

DETAILED DESCRIPTION OF THE INVENTION

Figure 1:
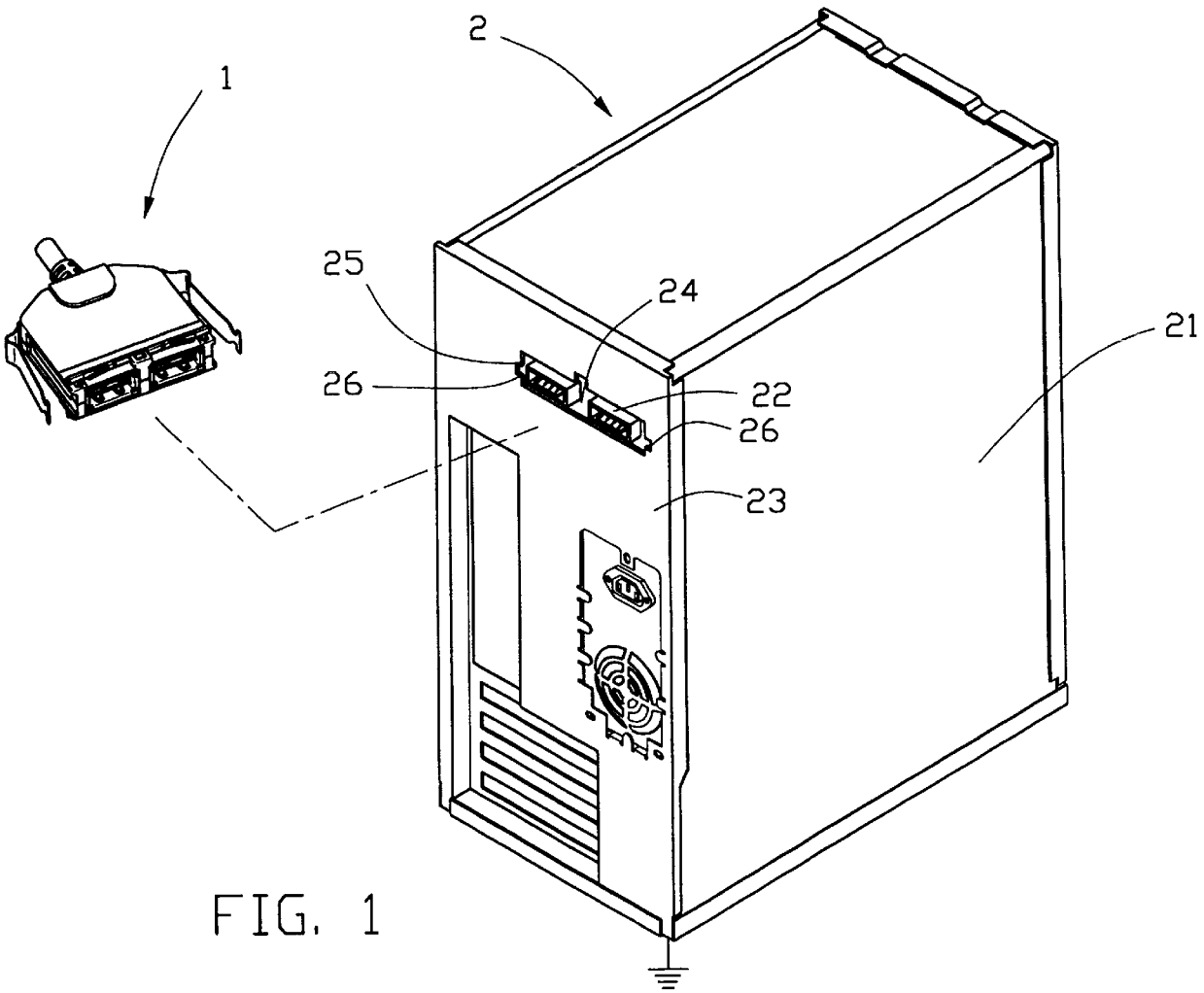
FIG. 1 is a perspective view of a cable connector assembly and a host device with which the cable connector assembly is going to mate.

In the following detailed description, reference is made to the accompanying drawings which form a part hereof. The drawings show by way of illustration a specific embodiment in which the invention may be practiced. The embodiment is described in sufficient detail to enable those skilled in the art to practice the invention, and it is to be understood that other embodiments may be utilized and that structural changes may be made without departing from the spirit and scope of the present invention. Therefore, the following detailed description is not to be taken in a limiting sense. The scope of the present invention is defined by the appended claims.

Referring to FIGS. 6–9, the present invention is related to a cable connector assembly device 100 including a cable connector assembly 1 and a shroud 80 partially covering the cable connector assembly 1. The shroud 80 is movable along a front-to-rear direction of the cable connector assembly Referring to the drawings in detail, and first to FIGS. 1 and 2, the cable connector assembly 1 is adapted for electrically connecting to an electronic apparatus 2, such as a host computer, for transmitting signals between the electronic apparatus and a complementary device. The electronic apparatus 2 comprises a case 21, two first connectors 22 fixed in the case 21 and a grounded panel 23 mounted in a rear side of the case 21, wherein the grounded panel 23 is electrically connected to a reference grounding potential in a manner known by those skilled in the art. The case 21 and the first connectors 22 are conventional, so details of them are omitted herein for conciseness. The grounded panel 23 defines a lengthwise opening 24. Four blocks 25 are formed adjacent to four comers of the opening 24, respectively. A notch 26 is defined in each opposite lateral side of the opening 24 and between two adjacent blocks 25 such that the cable connector assembly 1 can be reliably attached to the panel 23 of the electronic apparatus 2, as detailed below.

Figure 2:
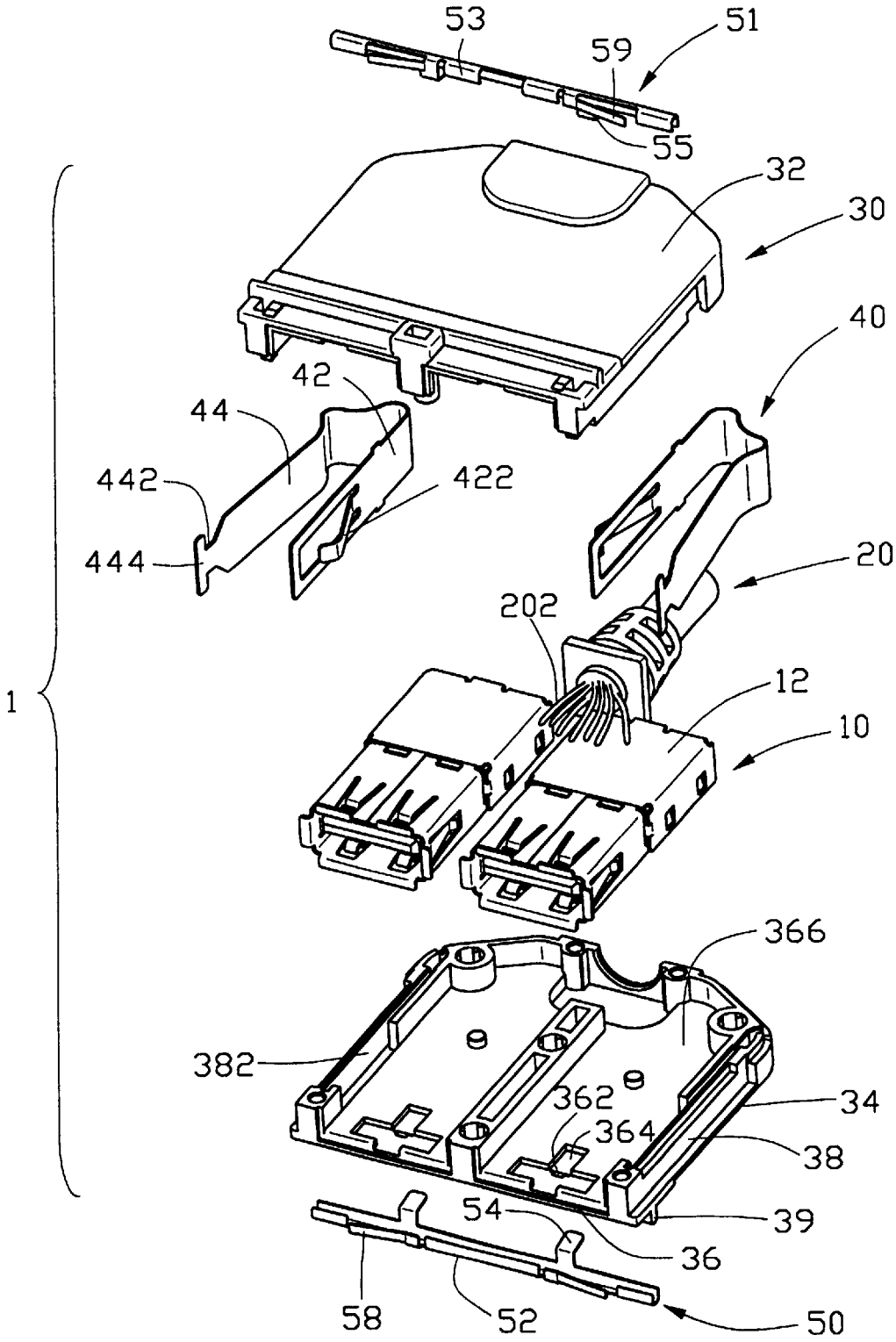
FIG. 2 is an exploded perspective view of the cable connector assembly of FIG. 1.

As shown in greater detail in FIG. 2, the cable connector assembly 1 comprises a pair of second connectors 10, such as USB connectors, a cable end 20 connecting to the pair of second connectors 10, a cover 30 enclosing the pair of second connectors 10 and the cable end 20 therein, and grounding means comprising a pair of conductive latches 40 and first and second grounding bars 50, 51 partially received in the cover 30, respectively. Each second connector 10 has a shrouded shell 12 generally enclosing an insulative housing and terminals thereof (not labeled) for protecting electronic signals transmitted through the terminals from external electromagnetic interference. The second connectors 10 and the cable end 20 are generally conventional; detailed descriptions of them are, therefore, omitted herein for conciseness.

The cover 30 preferably comprises an upper cover 32 and a lower cover 34 that are combined together by conventional means after elements that are required to be received in the cover 30 are correctly positioned therein. The upper and lower covers 32, 34 are generally structural mirror images of each other. Therefore, only the lower cover 34 is illustrated in great detail hereinafter, and the upper cover 32 may be known by referring to the lower cover 34. The lower cover 34 comprises a body portion 36 and a peripheral wall 38 extending perpendicularly upwards from the body portion 36. The body portion 36 defines a pair of slots 362 at a front portion thereof. A recess 364 is defined adjacent to a rear portion of each slot 362. Each recess 364 is recessed from an inner face 366 of the lower cover 34, and communicates with its adjacent slot 362. The body portion 36 further forms a rib 39 on an outer face thereof. Each peripheral wall 38 defines a channel 382 in each opposite sidewall thereof.

Each conductive latch 40 is generally V-shaped and comprises a first arm 42 and a second arm 44. The first arm 42 forms a spring cantilever 422 deflecting therefrom in a direction away from the second arm 44. The second arm 44 defines a V-cut 442 in each opposite side of a free end 444 thereof.

The first and second grounding bars 50, 51 are structurally similar to each other. Therefore, only the first grounding bar 50 is illustrated in great detail, and the second grounding bar 51 may be known by referring to the first grounding bar 50. The first grounding bar 50 comprises an elongate base portion 52 being generally U-shaped in cross-section. A pair of tabs 54 extend upwardly and then rearwardly from a middle portion of the base portion 52. The tabs 54 are spaced from each other a distance equal to that between the pair of slots 362 of the lower cover 34, thereby enabling the tabs 54 to be properly inserted into the slots 362, respectively. A pair of spring fingers 58 is formed at a front portion of the base portion 52, whereby each spring finger 58 has a free end spaced from the base portion 52 a distance. The two spring fingers 58 project in a forward direction and away from each other.

Figure 3:
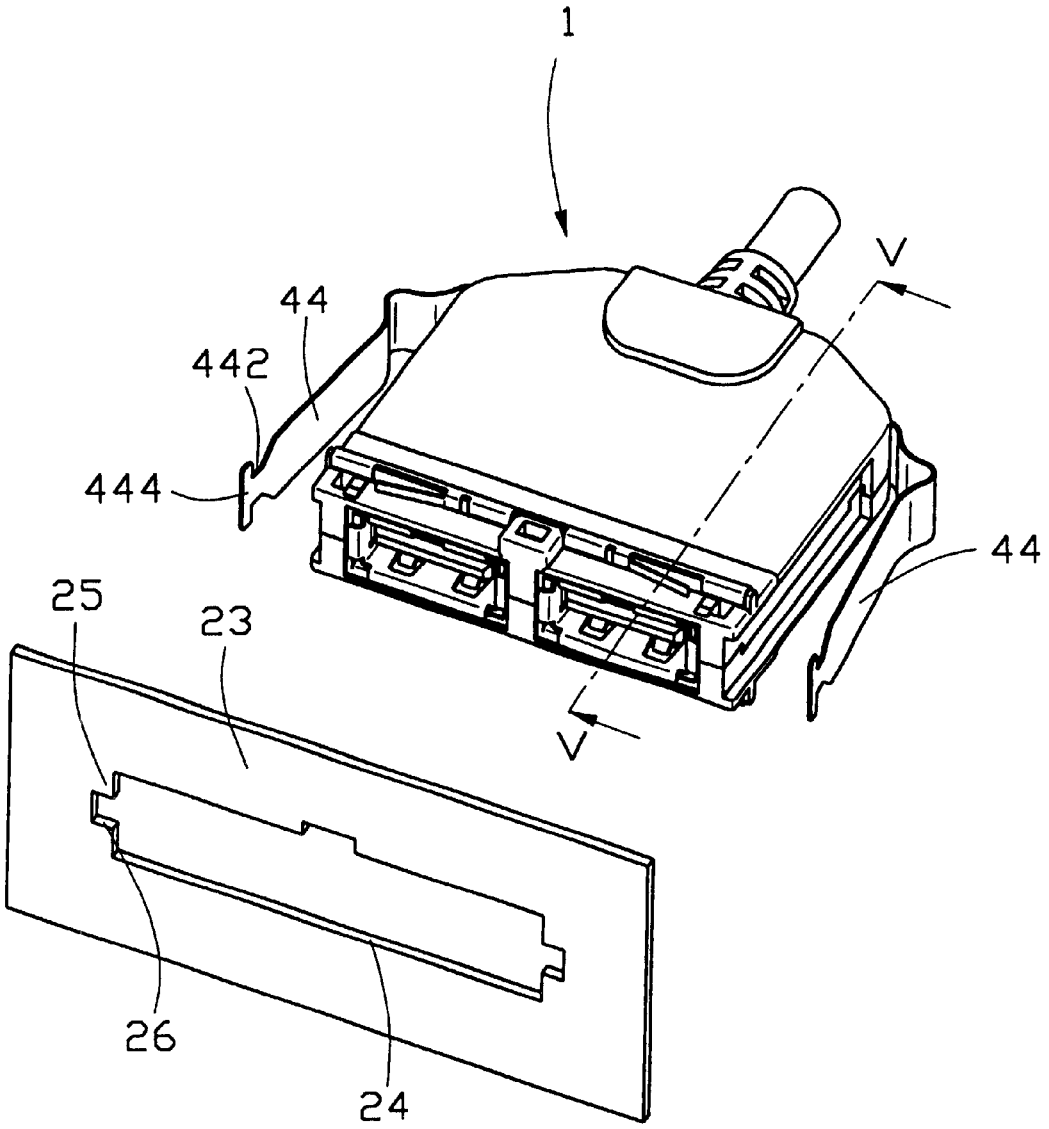
FIG. 3 is a perspective view of the assembled cable connector assembly of FIG. 2 and a part of a grounded panel of the host device of FIG. 1, prior to mating.
Figure 4:
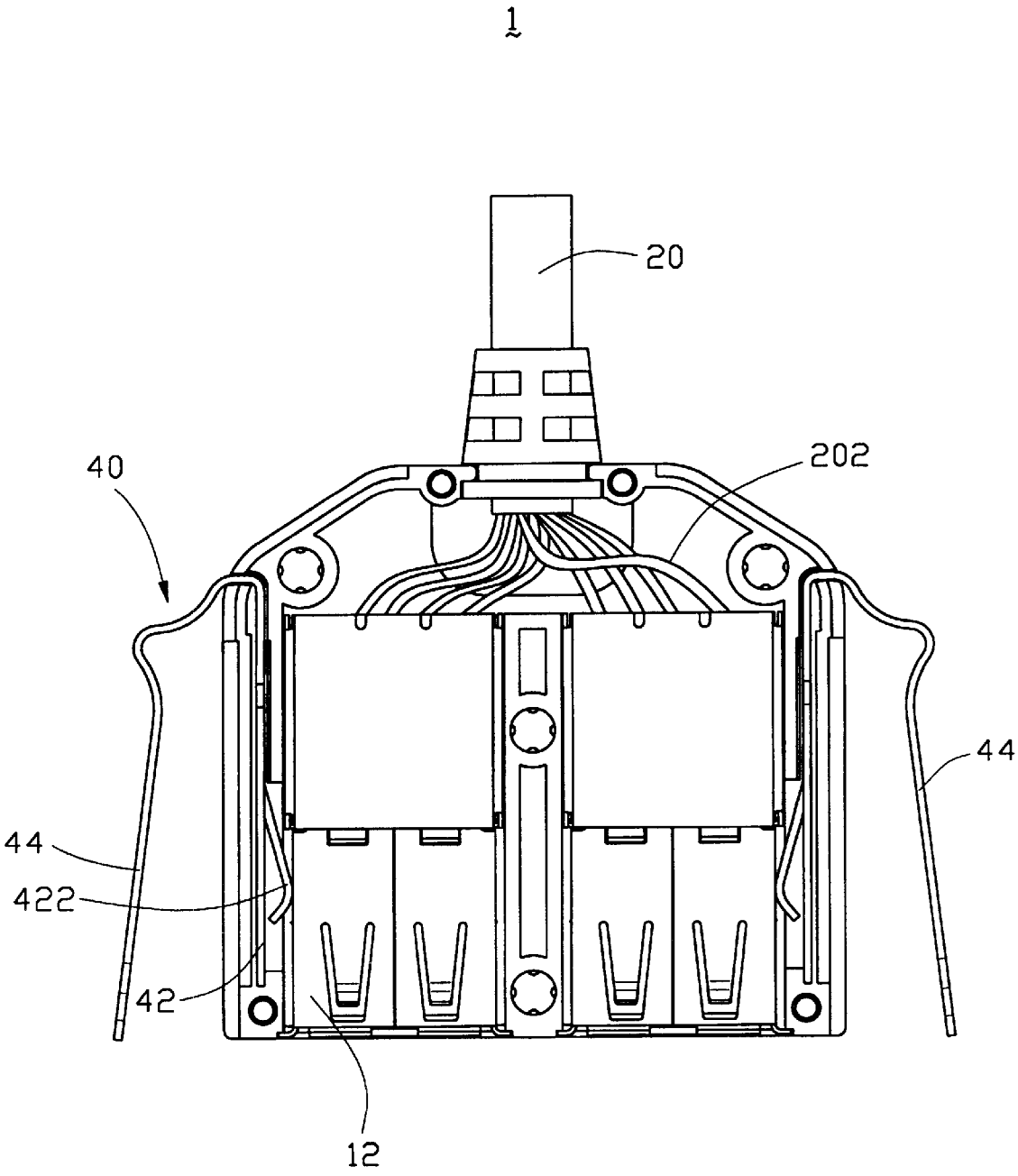
FIG. 4 is an enlarged top planar view of the cable connector assembly, wherein an upper cover of the cable connector assembly is removed therefrom to reveal an inner structure of the cable connector assembly.

Further referring to FIGS. 3 and 4, in assembly of the cable connector assembly 1, the second and first grounding bars 51, 50 are respectively attached to the upper and lower covers 32, 34. The base portion 52 of the first grounding bar 50 engagably receives the rib 39 of the lower cover 34. The pair of tabs 54 of the first grounding bar 50 extend through the pair of slots 362 into the recesses 364 of the lower cover 34. The second grounding bar 51 is similarly assembled to the upper cover 32. Base portions 52, 53 of each of the first and the second grounding bars 50, 51 are spaced a first distance from a front end of the cable connector assembly 1. Distal ends of spring fingers 58, 59 of each of the first and the second grounding bars 50, 51 are spaced a second distance from the front end of the cable connector assembly 1, whereby the second distance is shorter than the first distance. Tabs 54, 55 are then bent to deflect inward toward a center of the cover 30 from the recesses of the body portions of the upper and the lower covers 32, 34, such that a free end of each tab 54, 55 can resiliently engage with a shrouded shell 12 of a corresponding second connector 10. The cable end 20 is electrically connected to the pair of second connectors 10 by soldering conductive wires 202 of the cable end 20 to terminals (not shown) of the second connectors 10. The pair of second connectors 10 are then positioned side by side on the lower cover 34 such that bottom surfaces of the shrouded shells 12 abut against the free ends of the tabs 54 of the first grounding bar 50, respectively. Thus, the shrouded shells 12 are electrically connected together via the first grounding bar 50. The pair of conductive latches 40 are assembled to the lower cover 34 whereby each first arm 42 is engagably received in its corresponding channel 382, and each second arm 44 laterally extends away from the lower cover 34. Each spring cantilever 422 projects inwardly to resiliently abut against an outer lateral side of the shrouded shell 12 of the adjacent second connector 10. The upper cover 32 is then attached to the lower cover 34 by conventional means. Thus, the pair of tabs 55 of the second grounding bar 51 now resiliently engage with top portions of the shrouded shells 12 of the second connectors 10. Accordingly, static charge accumulated on the shrouded shells 12 may be dissipated therefrom through both the first and second grounding bars 50, 51. The completed assembly forms two ports (not labeled), so that the connector assembly 1 can simultaneously connect to the two first connectors 22 of the electronic apparatus 2 (FIG. 1).

Figure 5:
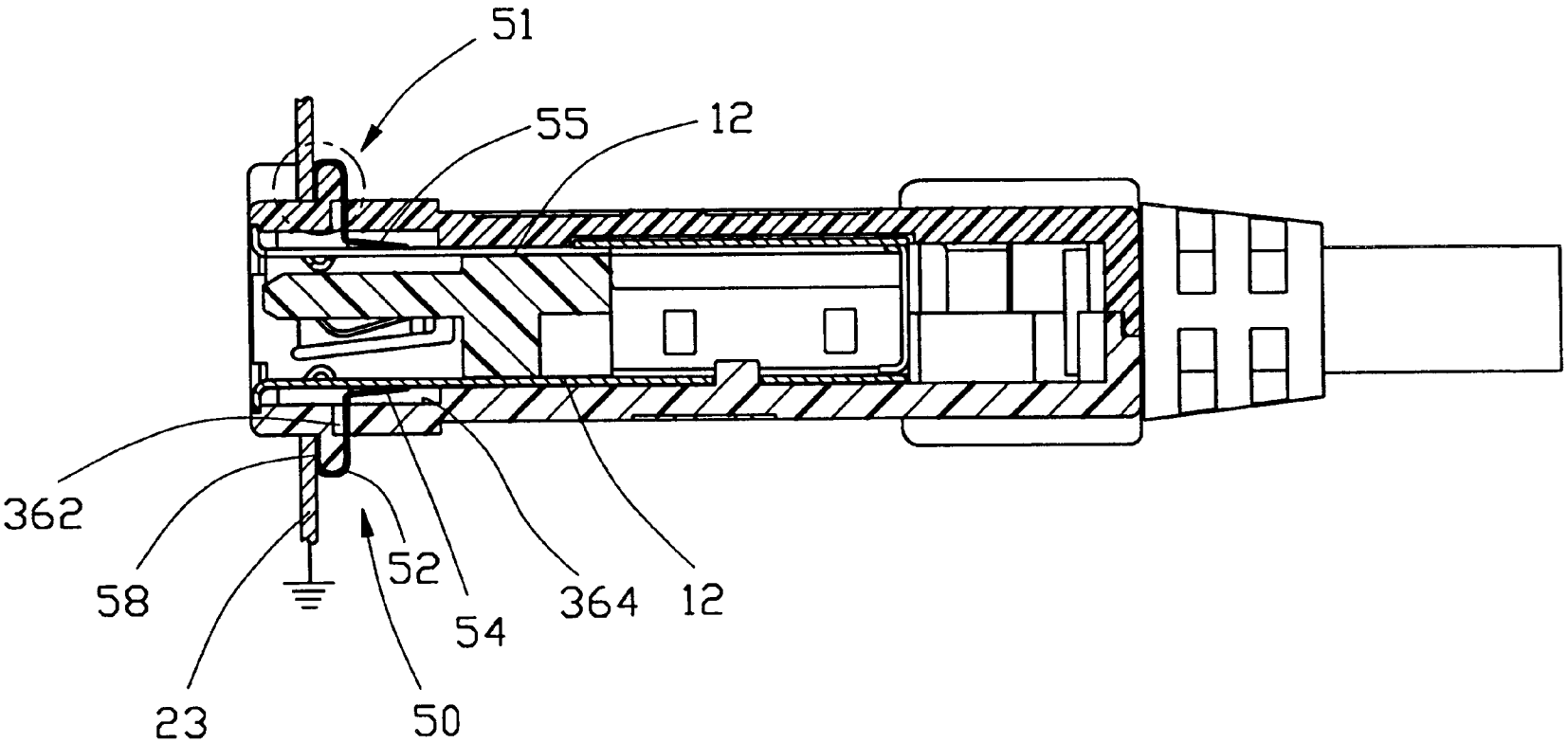
FIG. 5 is a cross-sectional view taken along line V—V of FIG. 3 to particularly show a grounding path between conductive shells of the cable connector assembly and the grounded panel of the host device.
Figure 5A:
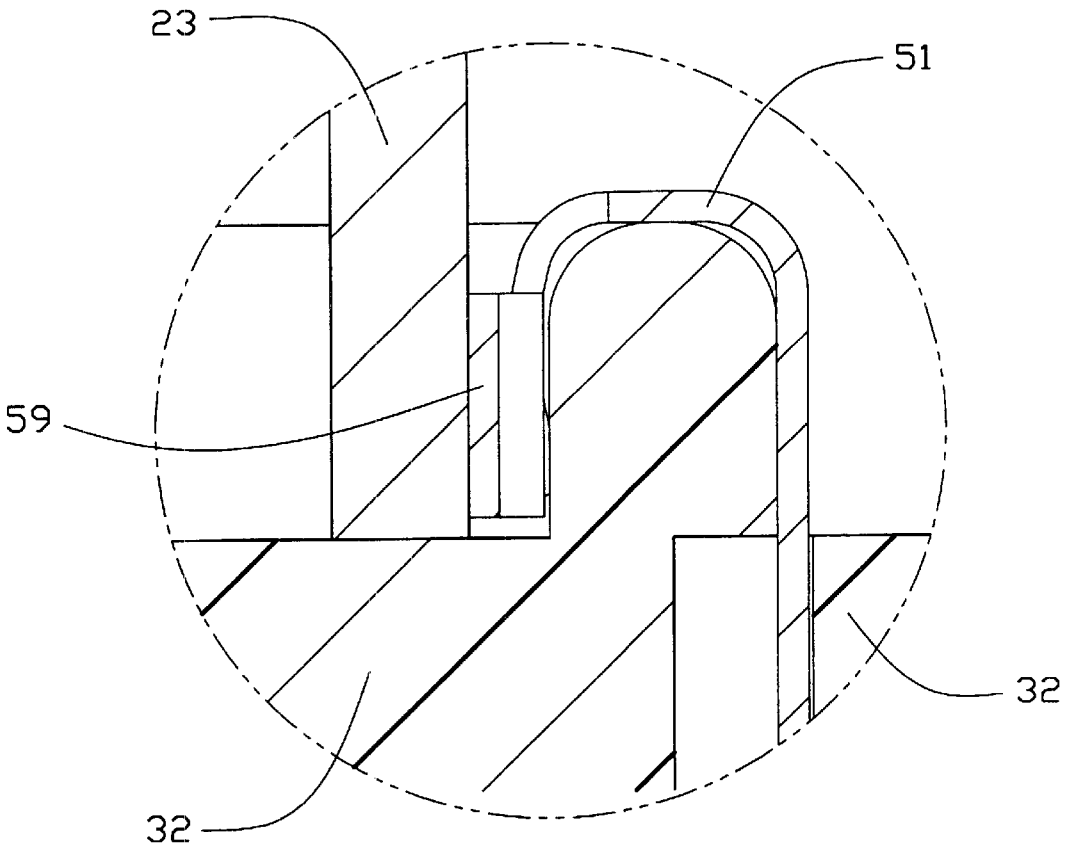
FIG. 5A is an enlarged partial view of FIG. 5, particularly showing electrical connection between the spring fingers of a grounding bar and the grounded panel of the host device.

Referring to FIGS. 3–5, when the cable connector assembly 1 is mated to the two first connectors 22 of the electronic apparatus 2, a front end of the cable connector assembly I is inserted through the opening 24 of the grounded panel 23. During insertion, the second arms 44 of the pair of conductive latches 40 are inwardly compressed by external force exerted thereon, such that each free end 444 is able to extend through the opening 24 of the grounded panel 23 between the adjacent first connectors 22 and the adjacent notch 26. After the pair of second connectors 10 respectively mate with the pair of first connectors 22 of the electronic apparatus 2, the external force is removed and the second arms 44 spring back outwardly. The free ends 444 of the second arms 44 are engagably received at innersurfaces of the grounded panel 23, with the V-cuts 442 engagably receiving edges of the blocks 25. This prevents accidental disengagement of the cable connector assembly 1 from the electronic apparatus 2, and also establishes a grounding path between each shrouded shell 12 and the grounded panel 23 of the electronic apparatus 2. The spring fingers 58, 59 (see FIG. 2) of the first and the second grounding bars 50, 51 resiliently press against an outer surface of the grounded panel 23 (see FIG. SA), whereby reliable electrical connection therebetween is established. Thus, the shrouded shells 12 are electrically connected to the grounded panel 23, which in turn is connected to a reference grounding potential by conventional means. When the shrouded shells 12 are connected to the reference grounding potential in this way, no static charge accumulates on the shrouded shells 12, thereby allowing signals to be successfully transmitted through the second connectors 10. The resilient pressing of the spring fingers 58,59 of the grounding bars 50, 51 against the front surface of the grounded panel 23 provides not only reliable electrical connection, but also a firm mechanical connection between the connector assembly 1 and the panel 23.

The preferred embodiment of the present invention described above comprises a pair of second connectors 10 arranged together side by side. An alternative embodiment of the present invention comprises two second connectors 10 stacked one above the other. In the preferred embodiment and the alternative embodiment, the second connectors 10 are individually formed. However, as is well known by those skilled in the art, a single connector with a housing and a shrouded shell and having a two-port configuration can be used to replace two individual second connectors 10.

Furthermore, as regards any of the above embodiments, the second connectors 10 are grounded to the grounded panel 23 via both the pair of conductive latches 40 and the first and second grounding bars 50, 51. In further alternative embodiments of the present invention, a selected one of the pair of conductive latches 40 and/or a selected one of the first and second grounding bars 50, 51 may be adequate to ground the two second connectors 10.

As stated above, the cable connector assembly device 100 further includes a shroud 80 which has a function of preventing the latches 40 from disengaging from the grounded panel 23, as will be described in great detail below.

Figure 6:
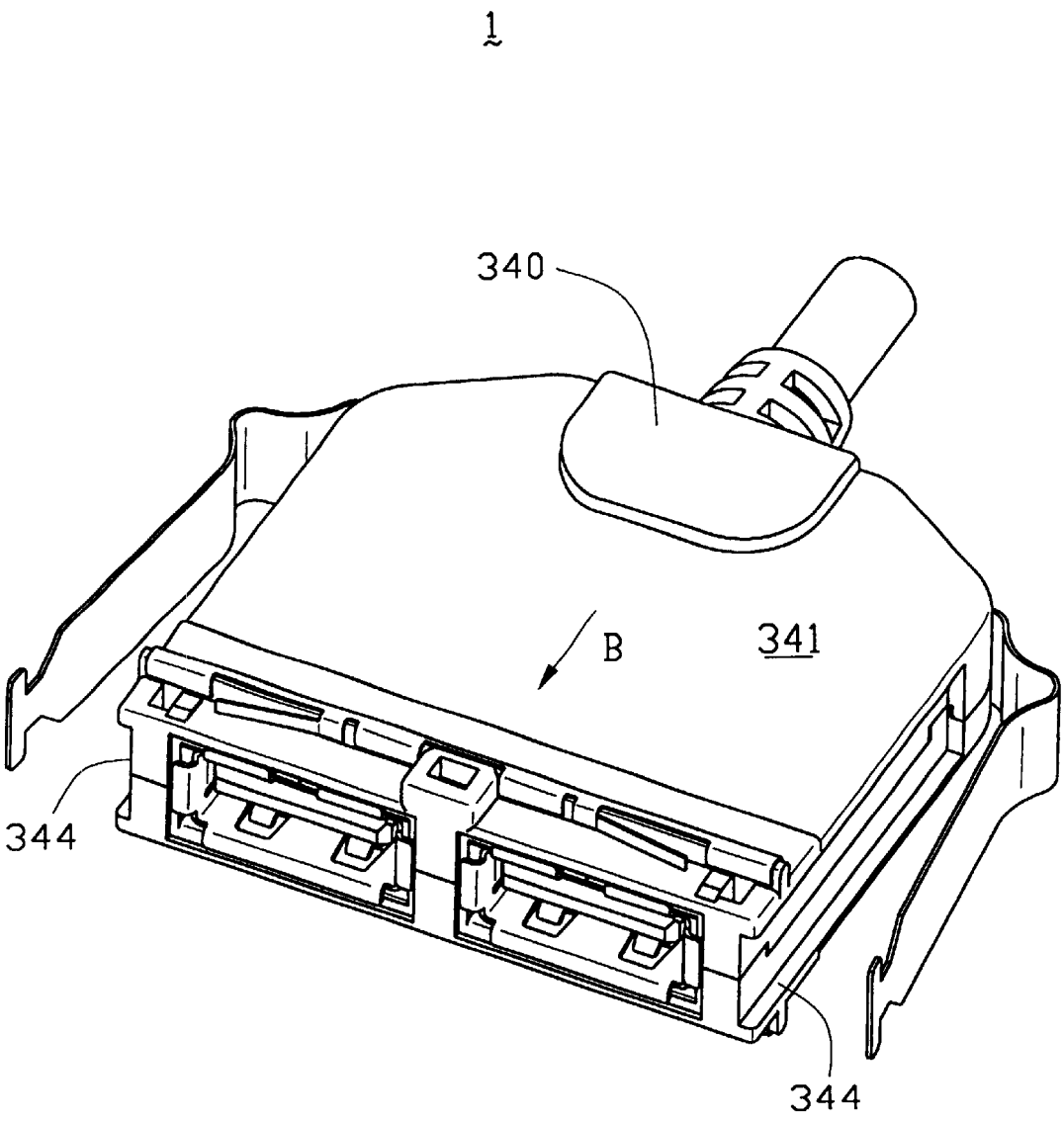
FIG. 6 is an enlarged perspective view of the cable connector assembly of FIG. 3.
Figure 7:
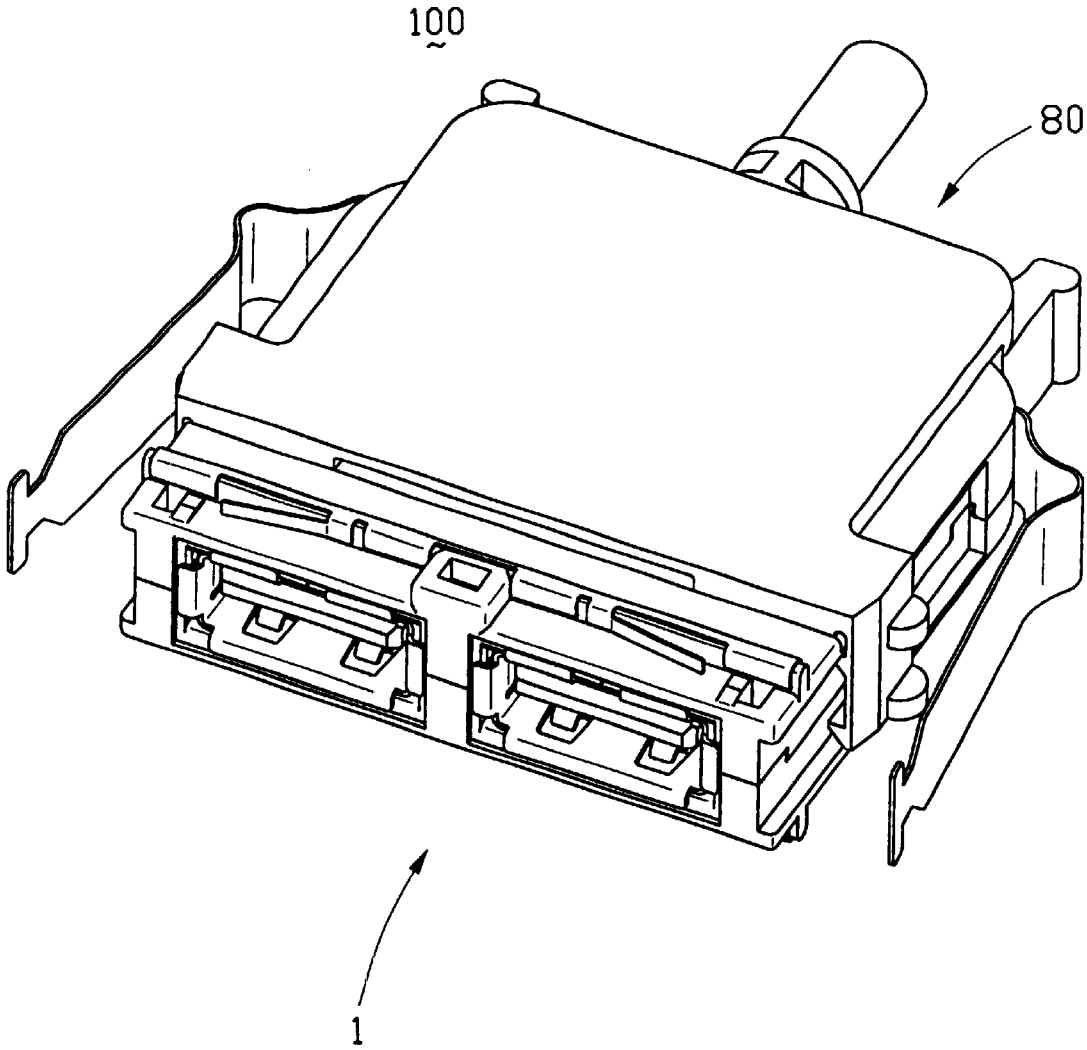
FIGS. 7 & 8 are enlarged perspective views of a cable connector assembly device of the present invention taken from two different perspectives which has the cable connector assembly of FIG. 6 and a shroud partially shrouding the cable connector assembly.
Figure 8:
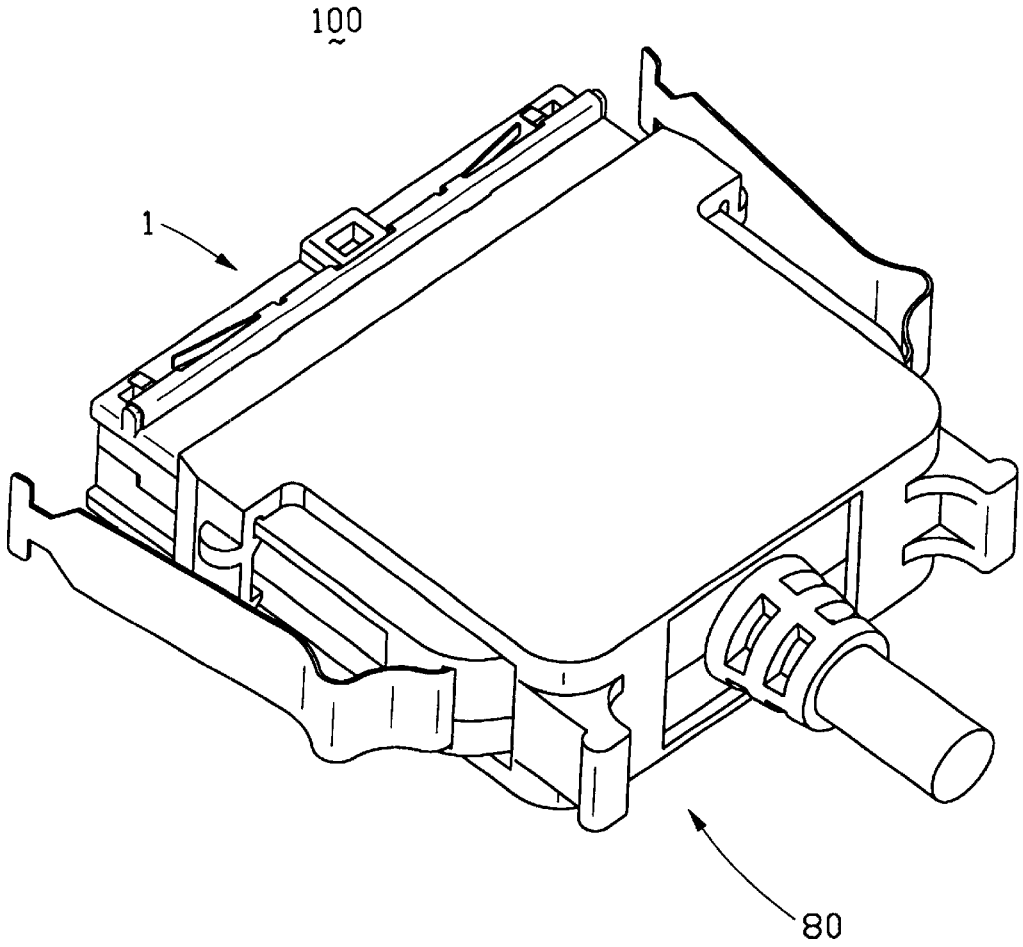
Figure 9:
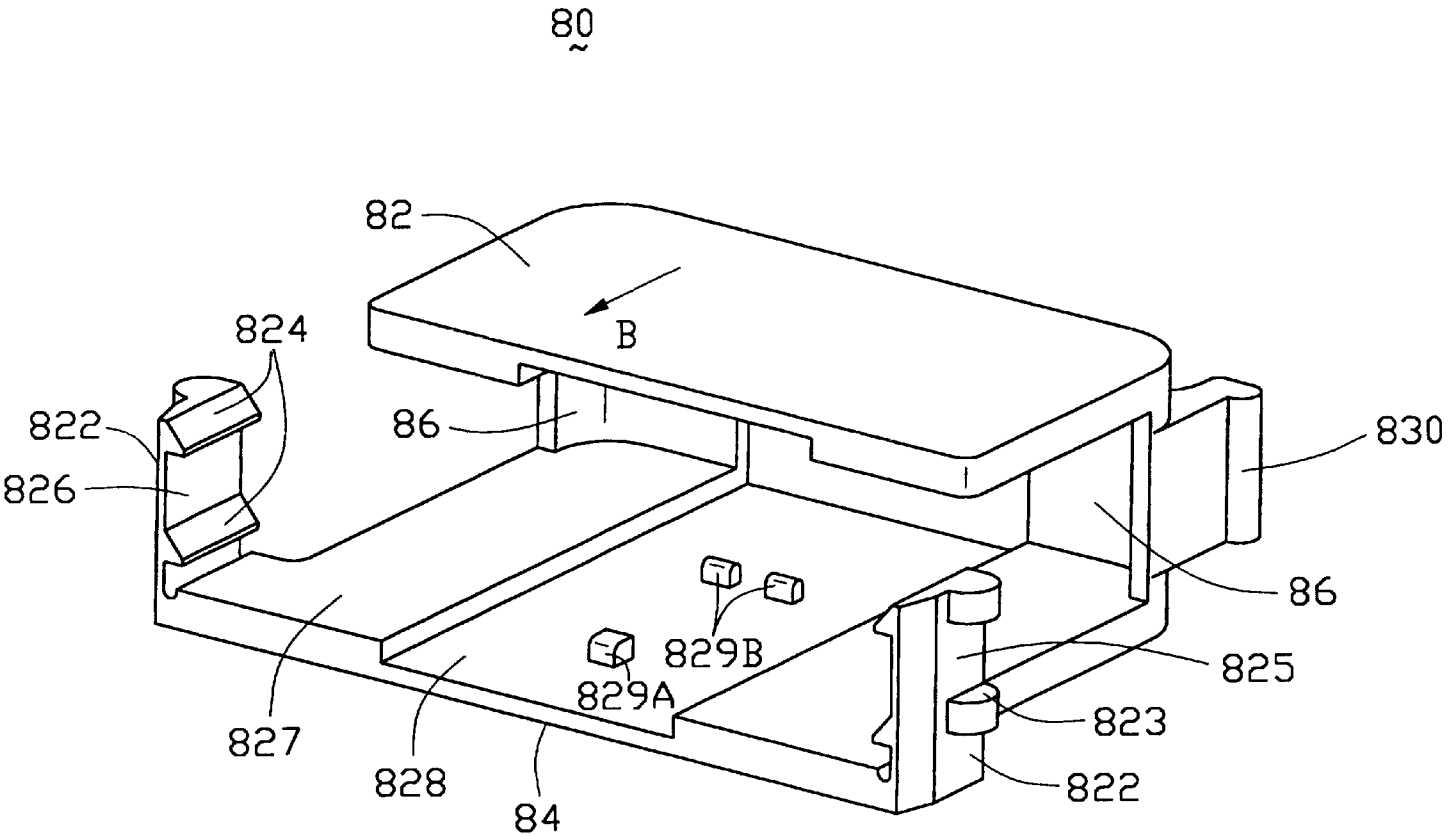
FIGS. 9 & 10 are perspective views of the shroud of FIGS. 7 & 8 turned upside-down.
Figure 10:
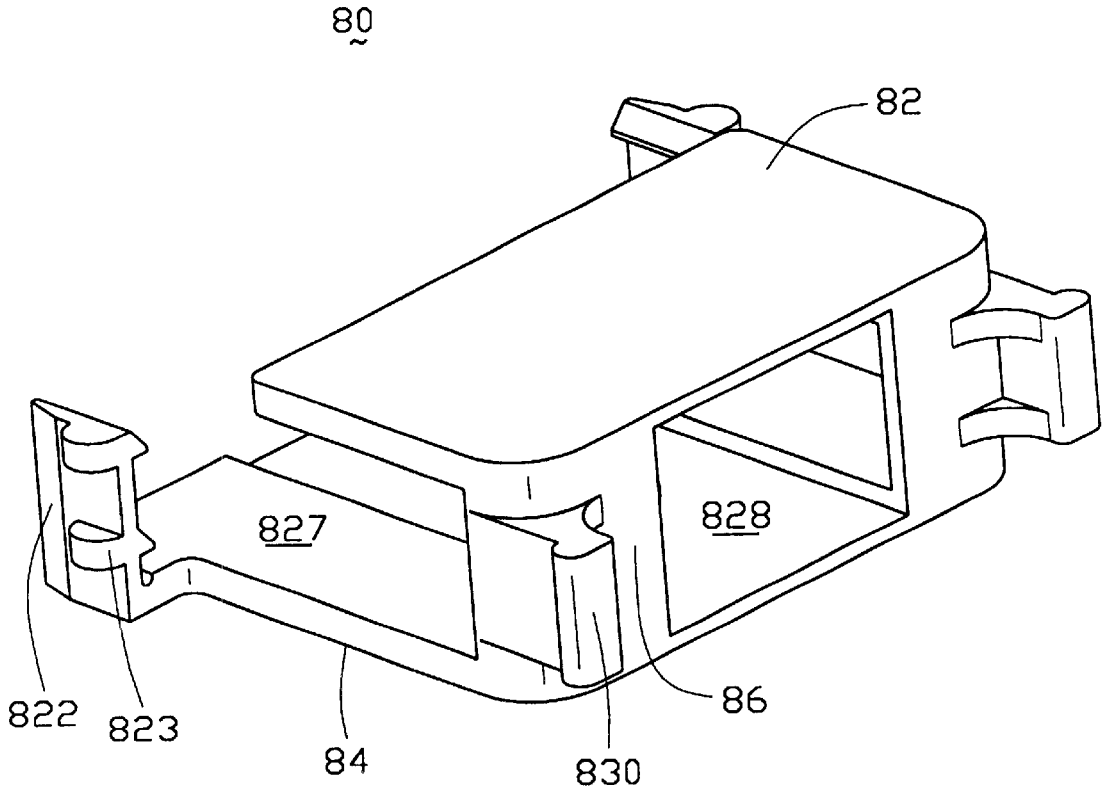
Figure 11:
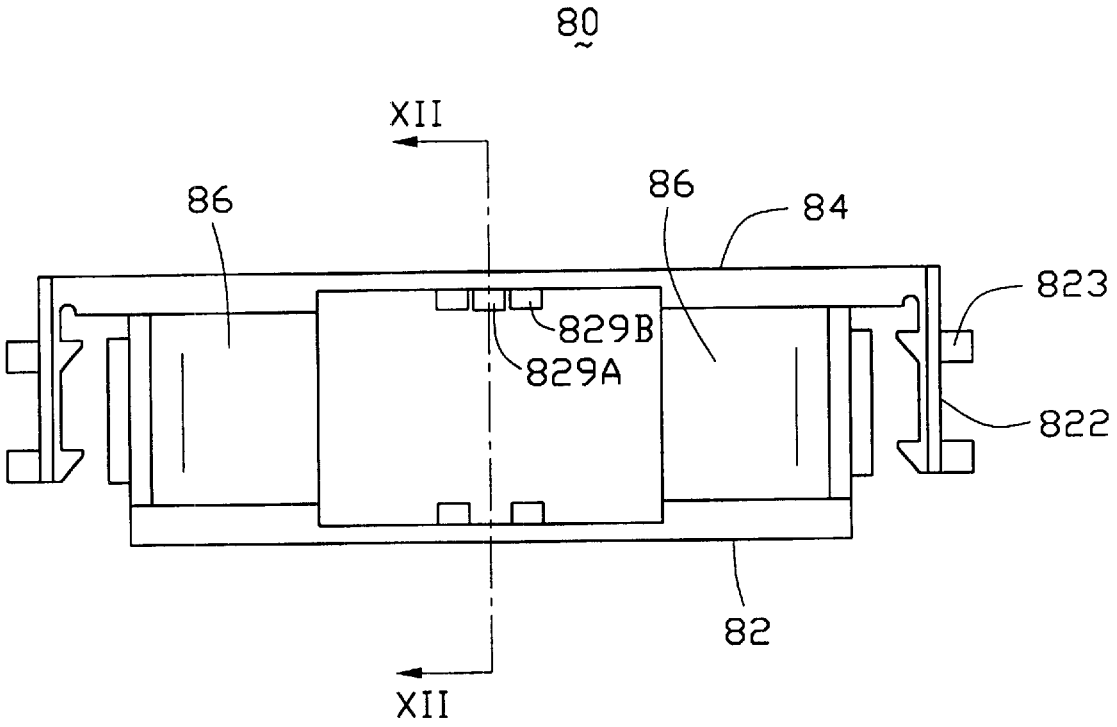
FIG. 11 is a front planar view of the shroud of FIG. 9 right side-up.
Figure 12:
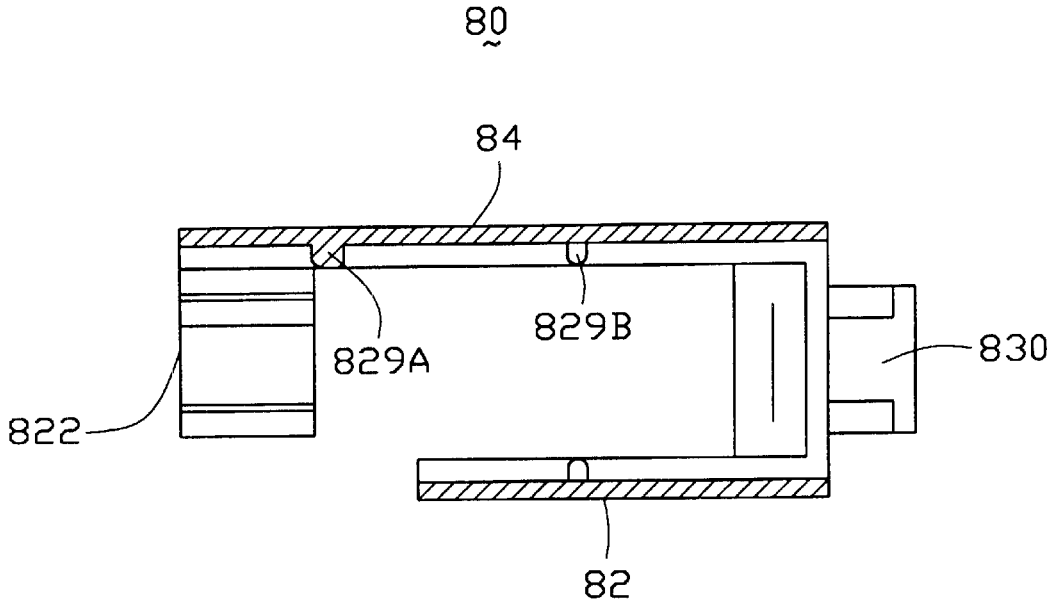
FIG. 12 is a cross-sectional view taken along line XII—XII of FIG. 11.

Referring to FIG. 6, the cable connector assembly 1 forms an embossment 340 at a rear portion of each upper and lower surface 341, 342 of the cover 30 (FIG. 13) and defines a groove 344 on each opposite lateral side of the cover 30.

Referring to FIGS. 9–12, the shroud 80 comprises a lower half 82 and an upper half 84 joined together by rear walls 86 thereof. The upper half 84 is longer than the lower half 82 in a rear-to-front direction (shown by arrow "B" in FIGS. 9 & 13) such that only the upper half 84 has a pair of protrusions 822 laterally and downwardly projecting from opposite front and lateral sides thereof. Each protrusion 822 forms a pair of ribs 824 on an inner wall 826 thereof, which is able to be slidably received in a corresponding groove 344 of the cover 30. Each protrusion 822 forms a pair of circular lips 823 on an outer wall 825 thereof which is able to abut against the second arm 44 to prevent the second arm 44 from moving inwardly to be disengaged from the grounded panel 23. Each of the lower and the upper halves 82, 84 defines a recessed face 828 in the rear-to-front direction thereof in an inner surface 827 thereof to slidably receiving the embossments 340 of the cover 30 therein. The upper and lower halves 84, 82 each forms a front block 829A and two rear blocks 829B in their respective recessed faces 828. The front block 829A is spaced in front of the rear blocks 829B in the rear-to-front direction "B" a distance appropriate to accommodate the corresponding embossment 340 of the cover 30 between the front and rear blocks 829A, 829B. The shroud 80 further forms a finger holder 830 rearwardly extending from each rear wall 86 thereof.

Figure 13:
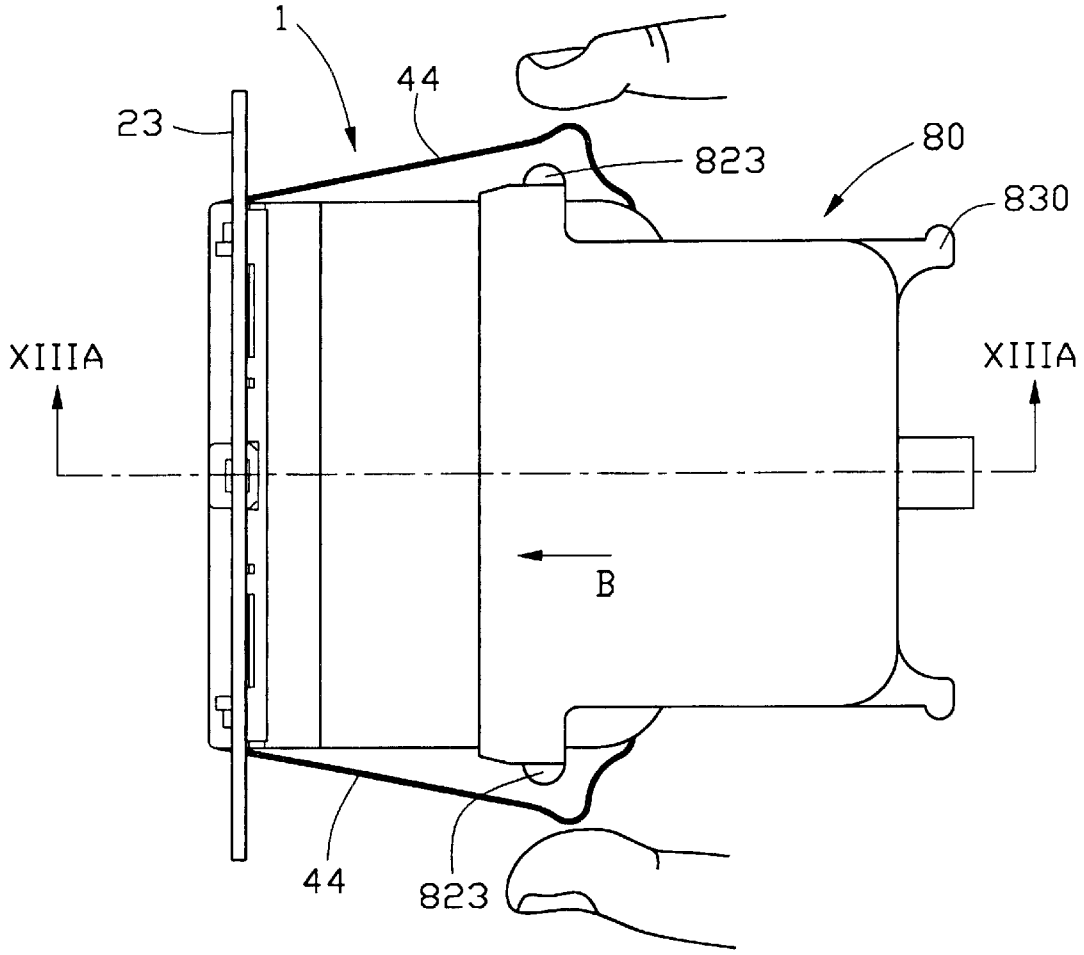
FIG. 13 is a top planar view of the cable connector assembly device while the shroud is positioned at a rear portion of the cable connector assembly and a pair of latches are inwardly compressed.
Figure 13A:
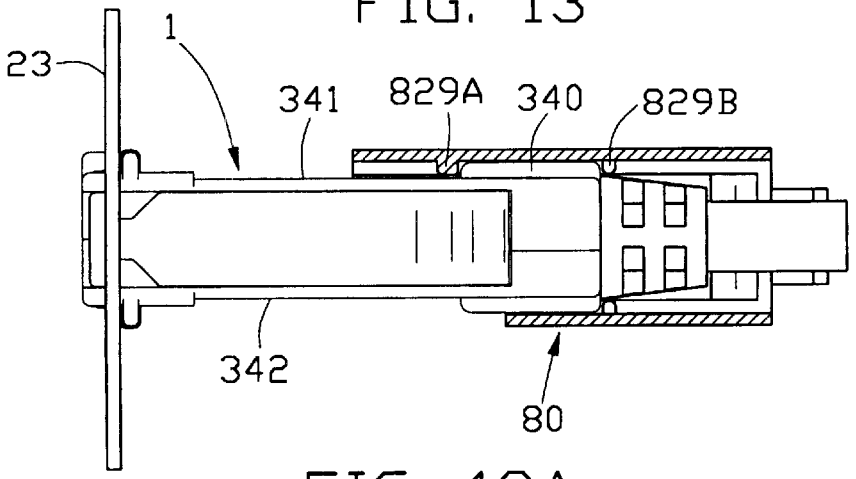
FIG. 13A is a side planar view of FIG. 13 while the shroud is cross-sectioned along line XIIIA—XIIIA.
Figure 14:
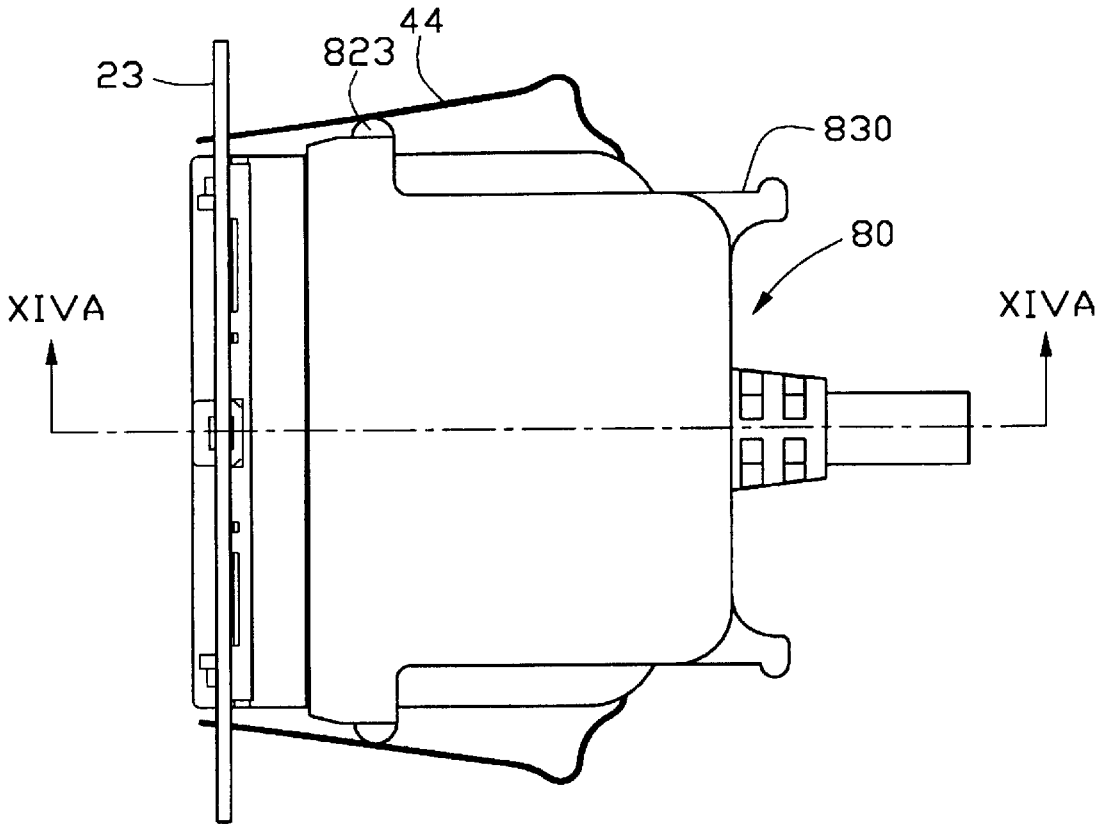
FIG. 14 is similar to FIG. 13 except that the shroud is positioned at a front portion of the cable connector assembly.
Figure 14A:
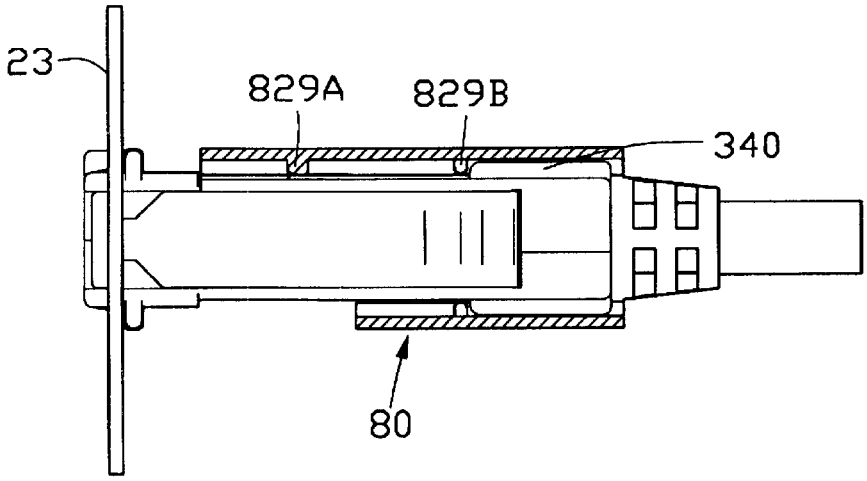
FIG. 14A is a side planar view of FIG. 14 while the shroud is cross-sectioned along line XIVA—XIVA.

Referring to FIGS. 13, 13A, 14 & 14A, the shroud 80 is rearwardly assembled to the cable connector assembly 1 with the ribs 824 of the protrusions 822 slidably engaging with the grooves 344 of the cover 30. The shroud 80 is moveable between an open position (as shown in FIGS. 13 & 13A) and a closed position (as shown in FIGS. 14 & 14A). In the open position, the shroud 80 is located at a rear portion of the cable connector assembly 1 and the embossments 340 of the cover 30 are accommodated between the front and rear blocks 829A, 829B. In the open position, the circular lips 823 of the shroud 80 abut against neither of the second arms 44 of the latches 40 and the second arms are ready to be inwardly compressed by an external force exerted thereon. In the open position, the cable connector assembly 1 can be mated with the first connectors 22 of the electronic apparatus 2 and the second arms 44 can be engaged with the grounded panel 23. When the shroud 80 is thereafter pushed in the rear-to-front direction "B" over the cable connector assembly 1 (see FIGS. 14 & 14A) by pushing against the finger holders 830, the rear blocks 829B travel over the embossments 340 of the cover 30 until the rear blocks 829B abut against a front face of the embossments 340 and the rear walls 86 abut against a rear face of the cover 30. The circular lips 823 of the protrusions 822 abut against the second arms 44 of corresponding latches 40. As a result, the second arms 44 can not be disengaged from the grounded panel 23 even under conditions of vibration. Therefore, the cable connector assembly device 100 is securely and reliably connected to the connectors 22 and the grounded panel 23 of the electronic apparatus 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. It is noted that a copending application of a related design with an unknown serial number while having the same title, the same assignee and one common inventor, is filed on the same date of this application.

What is claimed is:

1. An electrical cable connector assembly device adapted to connect with a complementary connector mounted on a grounded panel of an electronic apparatus, comprising:

at least a connector housing;

a plurality of contacts received in the connector housing;

a cable end attached to said housing and having a plurality of conductive wires connecting to corresponding contacts in the housing;

a cover enclosing the connector housing and the cable end, the connector housing being accessible to the complementary connector; and a pair of latches attached at opposite lateral sides of the cover, each latch having a first arm attached to the cover and a second arm extending to an outside of the cover, the second arm having a free end adapted for engaging with the grounded panel of the electronic apparatus; and a shroud slidably assembled to the cover, the shroud comprising an upper half and a lower half, the upper half being longer than the lower half in a rear-to-front direction thereof, only the upper half forming a pair of protrusions at opposite sides thereof, the shroud being slidably positioned between a first position in which said protrusions are away from said latches, and a second position in which said protrusions block inward movement of said latches;

wherein the pair of protrusions project laterally and then downwardly from opposite sides of the upper half of the shroud;

wherein each protrusion of the shroud forms at least one rib at an inner wall thereof and the cover defines a groove at each of opposite lateral sides thereof, the at least one rib being slidably received in a corresponding groove;

wherein each protrusion of the shroud forms at least one circular lip on an outer wall thereof which abuts against the second arm when the shroud is positioned in the second position;

wherein at least one of the upper and the lower halves forms at least one block on an inner surface thereof, the block being engageable with the cover to retain the shroud at two predetermined positions on the cover;

wherein the cover forms an embossment on at least one of upper and lower surfaces thereof and at least one of the upper and the lower halves defines a recessed face in an inner surface thereof, at least one block being formed on the recessed face and being engageable with the embossment such that the embossment is limitedly slidable along the recessed face;

further comprising at least a conductive shrouded shell enclosing the housing, wherein the first arm of each latch is in electrical connection with the conductive shrouded shell to establish an electrical connection with the grounded panel;

wherein the second arm defines a V-cut in each opposite side of the free end thereof for engaging with the grounded panel.

* * * * *